US005731555A

United States Patent [19]

Anagnos

[11] Patent Number: 5,731,555

[45] Date of Patent: Mar. 24, 1998

[54] LOUDSPEAKER ENCLOSURE HAVING A LOW REFLECTION/LOW DIFFRACTION BAFFLE

[75] Inventor: Daniel P. Anagnos, Grandview, N.Y.

[73] Assignees: Sony Corporation, Japan; Sony Electronics, Inc., U.S.

[21] Appl. No.: 766,775

[22] Filed: Dec. 13, 1996

[51] Int. Cl.[6] ..... A47B 81/06

[52] U.S. Cl. ..... 181/199; 181/146; 181/151

[58] Field of Search ..... 181/144, 146, 181/147, 148, 151, 166, 150, 199; 381/158, 188, 205

[56] References Cited

U.S. PATENT DOCUMENTS

| | | | |
|---|---|---|---|
| 3,771,621 | 11/1973 | Goettl | 181/150 |
| 3,993,345 | 11/1976 | Croup | 181/199 X |
| 4,167,985 | 9/1979 | Dunlavy | 181/148 |
| 4,289,929 | 9/1981 | Hathaway | 181/147 |
| 5,115,884 | 5/1992 | Falco | 181/151 X |

OTHER PUBLICATIONS

Sony, "Technical Design Concepts and Philosophy of the SS–M9 Loudspeaker," 1994 Sony Electronics Inc.

E.A.R. Technical Data Sheet TDS–09, Division, Cabot Safety Corporation, Delaware Industrial Park, Newark, DE 19713, undated.

*Primary Examiner*—Khanh Dang

*Attorney, Agent, or Firm*—Ronald P. Kananen

[57] ABSTRACT

A loudspeaker enclosure having a low reflection/low diffraction baffle for reducing acoustic reflections and diffraction. The baffle of the loudspeaker enclosure has a substantially entire front surface covered by a first layer of optimized acoustical foam for reducing acoustic reflections off of the front surface of the baffle and for reducing diffraction around the edges of the enclosure. A second layer of optimized acoustical foam is secured over the mounting flanges of the transducers, which are mounted to the baffle. The first and second foam layers are formed of a thin sheet casted, polyether urethane foam. A front surface of the first layer of foam is flush with a front surface of the second layer of foam. An interference fit is provided between the first and second layers of foam to prevent any gaps from being formed between the first and second layers. The first layer of foam is thicker than the second layer of foam. An inside diameter of the second layer of foam has a chamfer that tapers outwardly away from the transducer to maximize output dispersion characteristics of the transducer.

17 Claims, 2 Drawing Sheets

LOUDSPEAKER ENCLOSURE HAVING A LOW REFLECTION/LOW DIFFRACTION BAFFLE

BACKGROUND OF THE INVENTION

1. Field of the Invention

The present invention relates generally to arrangements for minimizing acoustic reflections and diffraction and, in particular, to a loudspeaker baffle that reduces, by a large degree, acoustic reflections and diffraction off of the front surfaces and edges of a loudspeaker enclosure.

2. Description of the Relevant Art

Almost all conventional loudspeakers are plagued by the following two acoustical problems: (1) reflection of the acoustical output from the transducers off of the front surface or baffle area of the loudspeaker cabinet; and (2) diffraction of the acoustical output from the transducers off of the edges that form the perimeter of the baffle portion of the loudspeaker cabinet, or any other discontinuities on the front baffle, such as grille frame mounts, screw heads, and so forth.

The reflection problem is responsible for the commonly referred to "baffle effect" which typically results in increased or reinforced output at midrange frequencies (300 Hz and above) relative to the lower bass frequencies (below 100 Hz). This amplitude boost is usually linearly increasing with frequency from 300 Hz to about 700 Hz; however, the frequencies at which the boost starts and reaches a maximum are determined by the actual baffle dimensions. These effects tend to be more dramatic and start higher in frequency as the baffle dimensions are reduced. These effects are typically dealt with by utilizing equalization in the loudspeaker crossover network.

The diffraction problem usually has more negative sonic consequences than the reflection problem. Sound produced by the transducers is diffracted by any sharp edges or discontinuities, causing additional phantom sources to appear in an improperly radiated sound field. An ideal sound field is created by a single point source. Diffraction produces a confusing superposition of phantom sources in addition to the primary point source, thereby creating multiple point sources that result in a less than ideal sound field.

Both effects will produce irregularities in the amplitude and phase response of the loudspeaker. The diffraction effects, in particular, tend to compromise the sound field imaging capability of the loudspeaker.

Many manufacturers have utilized rounded front baffle edges in an attempt to reduce diffraction. Unfortunately, the radius necessary to have a real benefit is very large, at least 50 mm or more. Smaller radii have very little effect, and only at very high frequencies. Most manufacturers have utilized radii on the order of 6 mm or less. Very large radii edges present significant manufacturing problems for cabinet-makers.

Baffle reflection effects have been addressed by some manufacturers by using pads of foam or felt around the transducers. Usually these areas are quite small relative to the overall baffle dimensions and, thus, do not solve most of the problem. In addition, the acoustical absorption characteristics of the common materials used and the typical thicknesses employed (usually less than 6 mm) are only effective at higher frequencies (above 5 kHz). It appears that most attempts to solve these problems have been marginally effective at best, and are primarily of significance to marketing hype.

SUMMARY OF THE INVENTION

It is an object of the present invention to provide a loudspeaker baffle that significantly reduces acoustic reflections and diffraction off the front surfaces and edges of a loudspeaker enclosure.

It is a further object of the present invention to minimize acoustic reflections and diffraction in a loudspeaker enclosure to provide an improved sound field.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

The present invention provides a loudspeaker baffle arrangement that reduces, by a large degree, acoustic reflections and diffraction off the front surfaces and edges of a loudspeaker enclosure. The loudspeaker baffle according to the invention prevents the acoustic output from transducers from reflecting off of the front surface of the baffle, as well as from diffracting around the edges of the loudspeaker enclosure. All non-moving surfaces on the frontal area of the loudspeaker are covered by approximately 25 mm of an optimized acoustical foam, while the mounting flanges of the loudspeaker transducers are covered by approximately 6 mm of an optimized acoustical foam.

In order to achieve the objects set forth above, the present invention comprises a loudspeaker enclosure comprising a baffle having at least one opening for mounting a loudspeaker transducer, a plurality of walls which define, together with the baffle, an enclosure, wherein a substantially entire front surface of the baffle is covered by a first layer of optimized acoustical foam for reducing acoustic reflections off of the front surface of the baffle and for reducing diffraction around edges of the enclosure.

The opening in the baffle is surrounded by a mounting surface for receiving a mounting flange of the transducer. The mounting flange of the transducer is sandwiched between the mounting surface of the baffle and a second layer of optimized acoustical foam. The first and second layers of foam are preferably formed of a thin sheet casted, polyether urethane foam material.

The first layer of foam has an opening surrounding the mounting surface, and the second layer of foam is fit into the opening of the first layer of foam. An interference fit is provided between the first and second layers of foam to prevent any gap from being formed between the first and second layers. The first layer of foam is thicker than the second layer of foam.

The second layer of foam comprises an inside diameter facing a diaphragm of the transducer. The inside diameter has a chamfer that tapers outwardly away from the transducer to maximize output dispersion characteristics of the transducer. A front surface of the first layer of foam is flush with a front surface of the second layer of foam.

In accordance with another aspect of the present invention, the objects set forth above are achieved by a method of making a loudspeaker enclosure, comprising the steps of forming a baffle member having at least one opening therein for mounting a loudspeaker transducer, the opening being surrounded by a mounting surface for receiving a mounting flange of the transducer, and attaching a first layer of optimized acoustical foam over a substantially entire front surface of the baffle member, the first layer of foam having at least one opening therethrough corresponding to the at least one opening in the baffle member.

The method preferably further comprises the steps of mounting a transducer to the baffle member by securing a mounting flange of the transducer to the mounting surface of the baffle member, and placing a second layer of optimized acoustical foam over the mounting flange of the transducer so as to sandwich the mounting flange between the mounting surface of the baffle member and the second layer of foam. An interference fit is provided between the first and second foam layers so as to prevent gaps between the first and second foam layers. The first and second foam layers have generally flush front surfaces.

The second layer of foam is preferably secured to the mounting flange of the transducer with a pressure sensitive adhesive backing. The baffle member is preferably assembled to the walls of the loudspeaker enclosure before attaching the first layer of foam to the baffle member.

BRIEF DESCRIPTION OF THE DRAWINGS

The various features and advantages of the present invention will become more clearly appreciated as a description of the invention is made with reference to the appended drawings. In the drawings.

DETAILED DESCRIPTION OF THE INVENTION

Preferred embodiments of the present invention will be described below by making reference to FIGS. 1 to 4 of the drawings.

Figure 1:
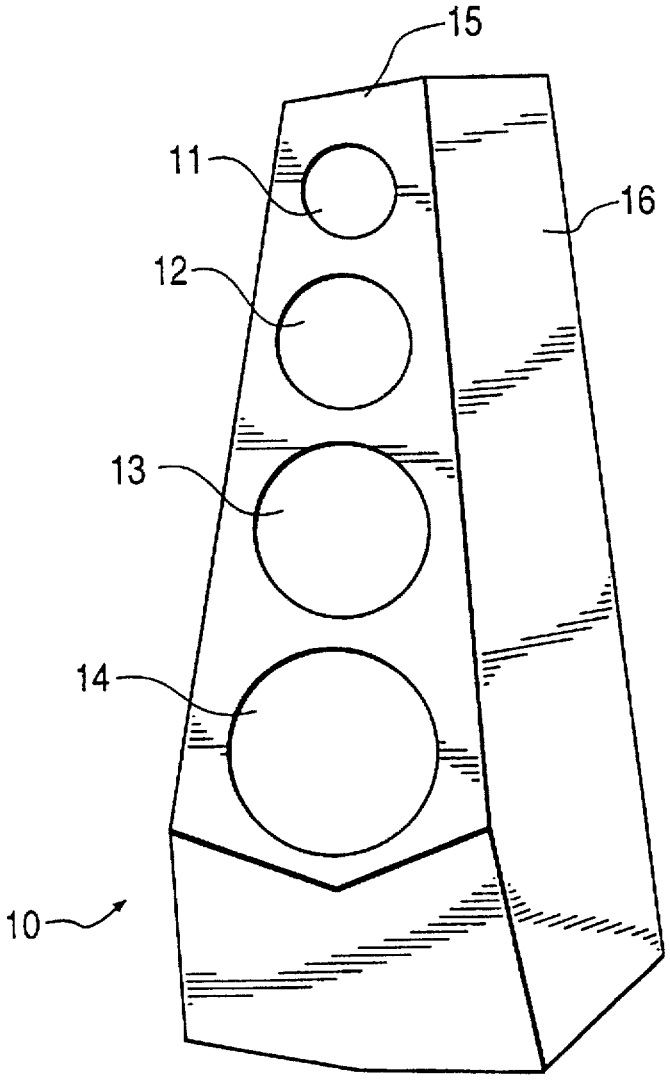
FIG. 1 is a perspective view of a loudspeaker equipped with a low reflection/low diffraction baffle according to the present invention.

The present invention was developed for use in a high performance loudspeaker, such as the loudspeaker 10 shown in FIG. 1. The loudspeaker 10 includes a plurality of speaker transducers 11, 12, 13, 14 (e.g., tweeter, midrange, woofer, and subwoofer, respectively). The speaker transducers are mounted to a baffle board 15 of a speaker cabinet. The speaker cabinet has side walls 16, a rear wall (not shown), and top and bottom walls (not shown), which, together with the baffle board 15, form an airtight enclosure. Various other electrical components (e.g., crossover networks) are mounted within the speaker cabinet.

According to the present invention, the entire front surface of the loudspeaker cabinet, i.e., the baffle board 15, is covered with a highly optimized acoustical foam. All front baffle surfaces are covered with a thickness of 25 mm of foam, except for the mounting flanges of the transducers 11, 12, 13, 14, which are covered with a thickness of 6 mm of foam. The front baffle area is also minimized as much as possible to reduce the amount of foam necessary.

The characteristics of the foam used to cover the baffle surfaces are of fundamental importance. The foam utilized is a thin sheet casted, polyether urethane foam with a textured (skinned) bottom surface, and optional skinned top surface. The foam is 25 mm thick with a 2 lb/ft$^3$ nominal density. The cell size and structure is optimized for consistent and ideal air flow resistivity per unit thickness; thus, sound absorption characteristics are maximized. With the foam covered baffle board 15, all reflection and diffraction effects are eliminated from 500 Hz frequencies and above.

Figure 2:
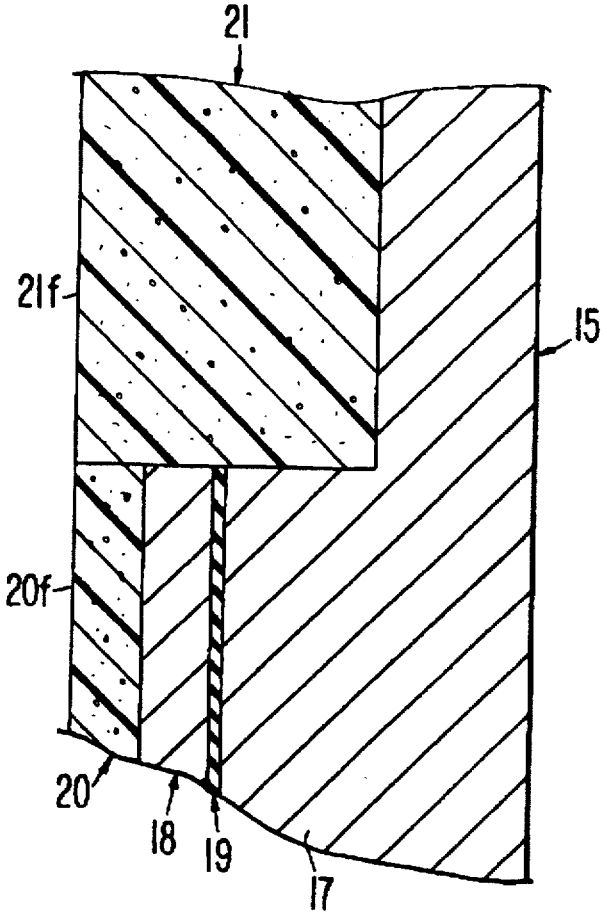
FIG. 2 is a cross section view of a portion of a low reflection/low diffraction loudspeaker baffle according to the present invention.

FIG. 2 shows details of the construction of the baffle board 15. The baffle board 15 includes a plurality of openings for mounting the transducers 11, 12, 13, 14. Each of the openings is surrounded by a mounting portion 17 on which a mounting flange 18 of a frame of each of the transducers 11, 12, 13, 14 is secured. Each mounting portion 17 comprises a flat surface approximately the same width as the mounting flange 18 of the transducer. A gasket 19 is placed over the flat surface, the transducer mounting flange 18 is placed over the gasket 19, and an optimized acoustical foam 20 is placed over the transducer mounting flange 18.

The rest of the front baffle board 15 is covered by an optimized acoustical foam layer 21 having a front surface **21*f* that is flush with a front surface 20*f* of the foam layer 20 over the mounting flange 18. For example, the mounting portions 17 below the transducer mounting flanges 18 can be raised by approximately 12.7 mm relative to the rest of the baffle member 15. When combined with a typical mounting flange thickness of 6 mm and a 6 mm thickness of the foam layer 20 over the transducer mounting flange 18**, this will allow for approximately 25 mm of net foam thickness and a completely flush appearance.

Figure 3:
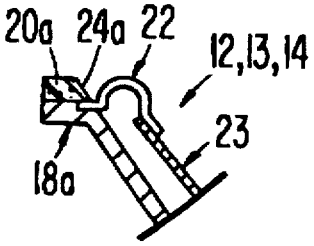
FIG. 3 is a cross section view of a portion of the loudspeaker baffle according to the present invention adjacent a midrange or woofer transducer.
Figure 4:
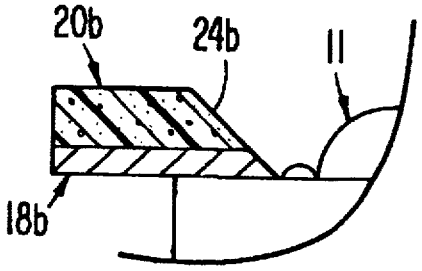
FIG. 4 is a cross section view of a portion of the loudspeaker baffle according to the present invention adjacent a tweeter transducer.

FIGS. 3 and 4 show further details of the loudspeaker baffle 15 adjacent the loudspeaker transducers. As shown in FIG. 3, a midrange or woofer transducer 12, 13, 14 has a mounting flange **18*a* around its periphery which is covered by an optimized acoustical foam layer 20*a* according to the present invention. The foam layer 20*a* also covers a portion of a surround member 22 which extends between the mounting flange 18*a* and the diaphragm 23 of the transducer. The foam layer 20*a* has a chamfer 24*a*** about its inner diameter to maximize the output dispersion characteristics of the transducer.

Similarly, in FIG. 4, a tweeter transducer 11 has a mounting flange **18*b* around its periphery which is covered by an optimized acoustical foam layer 20*b* according to the present invention. The foam layer 20*b* has a chamfer 24*b* about its inner diameter to maximize the output dispersion characteristics of the tweeter transducer 11**.

A suitable material for the optimized acoustical foam layers of the present invention is manufactured by E-A-R Specialty Composites, a division of Cabot Safety Corporation, and is sold under the proprietary name TUF-COTE™ Foam Products (Part Nos. E-25SF and E-100SF). The following Table 1 provides a listing of acceptable physical and strength properties for the acoustical foam layer material according to the preferred embodiment.

TABLE 1

PROPERTIES OF ACOUSTICAL FOAM LAYER MATERIALS

| PROPERTY | TEST METHOD | E-25SF | E-100SF |
|---|---|---|---|
| Thickness | | 0.25 in. (6.4 mm) | 1.0 in. (25.4 mm) |
| Density Nominal (lb/ft$^3$) | ASTM D3574 | 2.0 | 2.0 |

TABLE 1-continued

PROPERTIES OF ACOUSTICAL FOAM LAYER MATERIALS

| PROPERTY | TEST METHOD | E-25SF | E-100SF |
|---|---|---|---|
| Weight Nominal ($lb/ft^2$) | ASTM D3574 | 0.04 | 0.17 |
| Flame | UL 94H | Meets HF-1 | Meets HF-1 |
| | MVSS 302 | Passes | Passes |
| | FAR 25.853(b) | Passes | Passes |
| | SAE J369(a) | Meets | |
| Random Incidence Acoustical Absorption Coefficient | ASTM C423-84a and ASTM E795-83 (Mounting A) | | |
| | @ 125 Hz | 0.00 | 0.17 |
| | @ 250 Hz | 0.03 | 0.25 |
| | @ 500 Hz | 0.23 | 0.73 |
| | @ 1000 Hz | 0.71 | 1.14 |
| | @ 2000 Hz | 0.71 | 0.99 |
| | @ 4000 Hz | 0.26 | 1.02 |
| | NRC | 0.40 | 0.80 |
| Thermal Conductivity (K.) (BTU in./hr. $ft^2$ °F.) | ASTM C177 | | 0.27 |
| Thermal Resistivity (R) (hr. $ft^2$ °F./BTU) | ASTM C177 *calculated from 1" foam value | 0.9* | 3.6 |
| Tensile Strength | ASTM D3574 Foam: | | |
| | lb. @ 23° C. amb. hum. | | 12 |
| | lb. @ 70° C. 100% hum. | | 13 |
| | lb. @ 100° 100% hum. | | 15 |
| Tear Strength | ASTM D3574 Foam: lb./in. | | 1.9 |
| Elongation (foam only) | ASTM D3574 | | |
| | % @ rm.t. amb.hum. | | 234 |
| | % @ 70° C. 100% hum. | | 239 |
| | % @ 100° C. 100% hum. | | 248 |
| Compression Set | ASTM D3574 (% of original height @ 50% initial deflection, 70° C. for 22 hr.) | | 18 |
| Compression-Deflection | ASTM D3574 @ 50% Compression | | |
| | @ rm.t. amb.hum., psi | | 0.40 |
| | @ 70° C. 100% hum., psi | | 0.51 |
| | @ 100° C. 100% hum., psi | | 0.64 |

The foam pieces can be easily and precisely die cut using common techniques. Although the foam is available with a pressure sensitive adhesive (PSA) backing, it is preferred that a PSA backing not be utilized for the main 25 mm thick foam layer 21 because of the large size and precise placement necessary during assembly. The foam layer 21 should be glued using an adhesive having a reasonable set time of 30 seconds to 1 minute. The foam layer 21 preferably has a skinned surface on the bottom to prevent the glue from wicking up into the foam body.

The small, 6 mm thick foam layer 20, however, preferably has a PSA backing for ease of assembly. As shown in FIGS. 3 and 4, a chamfer 24*a*, 24*b* is provided on the inside diameter (facing the diaphragm) of the openings of the 6 mm foam layer 20 covering the transducer flanges 18*a*, 18*b* in order to maximize the output dispersion characteristics of the transducers.

Attachment of the main 25 mm foam layer 21 to the front baffle 15 is preferably the last step of cabinet subassembly (after finishing of the cabinet). The final 6 mm foam layer pieces 20*a*, 20*b* are then applied after the transducers are properly mounted in the front baffle 15. An overlap of approximately 0.5 mm (interference fit) is preferably provided between the inside diameter of the 25 mm thick foam layer 21 and the outside diameter of the 6 mm thick foam layer 20 in order to prevent the possibility of a gap forming between the various pieces.

The foam itself is available with edge sealing (a skin around all edges) or completely open-celled (without a top skinned surface) in order to satisfy aesthetic concerns.

It should be noted that any type of loudspeaker cabinet material can be utilized without compromising the principles outlined above. Molded or fabricated plastic enclosures, for example, can be easily adapted to use the foam covered baffle according to the present invention.

The invention described in this disclosure refers specifically to a loudspeaker design; however, the principles set forth could be applied to any situation in which reflective and diffractive effects from 500 Hz to 30 kHz need to be minimized, particularly near the proximity of a sound source. A possible situation for use of the principles of the present invention would be in the design of integrated television speakers. Another adaptation may be in the design of microphones.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

The invention claimed is:

1. A loudspeaker enclosure, comprising:

a baffle having at least one opening for mounting a loudspeaker transducer; and a plurality of walls which define, together with said baffle, an enclosure;

a first and a second layer of optimized acoustical foam;

wherein a substantially entire front surface of said baffle is covered by said first layer of optimized acoustical foam for reducing acoustic reflections off of the front surface of the baffle and for reducing diffraction around edges of the enclosure, wherein said at least one opening in said baffle is surrounded by a mounting surface for receiving a mounting flange of the transducer, said mounting flange being sandwiched between said mounting surface and said second layer of optimized acoustical foam, and wherein said first layer of foam is thicker than said second layer of foam.

2. The loudspeaker enclosure according to claim 1, wherein said first layer of foam has an opening surrounding said mounting surface, and said second layer of foam is fit into the opening of said first layer of foam.

3. The loudspeaker enclosure according to claim 2, wherein an interference fit is provided between said first layer of foam and said second layer of foam to prevent any gap from being formed between the first and second layers.

4. The loudspeaker enclosure according to claim 1, wherein said second layer of foam comprises an inside diameter facing a diaphragm of the transducer, said inside diameter having a chamfer that tapers outwardly away from the transducer to maximize output dispersion characteristics of the transducer.

5. The loudspeaker enclosure according to claim 1, wherein a front surface of said first layer of foam is flush with a front surface of said second layer of foam.

6. The loudspeaker enclosure according to claim 1, wherein said second layer of foam comprises a thin sheet casted, polyether urethane foam.

7. The loudspeaker enclosure according to claim 1, wherein said second layer of foam is approximately 6 mm thick with a nominal density of approximately 2 $lb/ft^3$.

8. The loudspeaker enclosure according to claim 1, wherein said first layer of foam comprises a thin sheet casted, polyether urethane foam.

9. The loudspeaker enclosure according to claim 8, wherein said first layer of foam comprises a skinned surface on a side facing said baffle.

10. The loudspeaker enclosure according to claim 1, wherein said first layer of foam is approximately 25 mm thick with a nominal density of approximately 2 $lb/ft^3$.

11. A method of making a loudspeaker enclosure, comprising the steps of:

forming a baffle member having at least one opening therein for mounting a loudspeaker transducer, the opening being surrounded by a mounting surface for receiving a mounting flange of the transducer; and attaching a first layer of optimized acoustical foam over a substantially entire front surface of the baffle member, the first layer of foam having at least one opening therethrough corresponding to the at least one opening in the baffle member, and placing a second layer of optimized acoustical foam over the mounting flange of the transducer so as to sandwich the mounting flange between the mounting surface of the baffle member and the second layer of foam, wherein the first layer of foam is thicker than the second layer of foam.

12. The method according to claim 11, further comprising the steps of:

mounting a transducer to said baffle member by securing a mounting flange of the transducer to the mounting surface of the baffle member; and wherein the first and second foam layers have front surfaces that are generally flush with each other.

13. The method according to claim 12, further comprising the step of providing an interference fit between the first and second foam layers so as to prevent a gap from being formed between the first and second foam layers.

14. The method according to claim 12, further comprising the step of securing the second layer of foam to the mounting flange of the transducer using a pressure sensitive adhesive backing on the second layer of foam.

15. The method according to claim 12, wherein said first and second foam layers are each made of a thin sheet casted, polyether urethane foam.

16. The method according to claim 12, further comprising the step of forming a chamfer about an inner circumference of the second layer of foam to maximize output dispersion characteristics of the transducer.

17. The method according to claim 11, further comprising the step of assembling the baffle member to walls of the loudspeaker enclosure before attaching the first layer of foam to the baffle member.

* * * * *